US006691510B2

(12) United States Patent
Kariya et al.

(10) Patent No.: US 6,691,510 B2
(45) Date of Patent: Feb. 17, 2004

(54) PIPE BREAKAGE CONTROL VALVE DEVICE

(75) Inventors: Masao Kariya, Tsuchiura (JP); Genroku Sugiyama, Ibaraki-ken (JP); Tsukasa Toyooka, Ibaraki-ken (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 0 days.

(21) Appl. No.: 10/018,530

(22) PCT Filed: May 15, 2001

(86) PCT No.: PCT/JP01/04011

§ 371 (c)(1),
(2), (4) Date: Dec. 20, 2001

(87) PCT Pub. No.: WO01/88382

PCT Pub. Date: Nov. 22, 2001

(65) Prior Publication Data

US 2002/0157529 A1 Oct. 31, 2002

(30) Foreign Application Priority Data

May 19, 2000 (JP) ..... 2000-148434

(51) Int. Cl.[7] ..... F15B 11/042
(52) U.S. Cl. ..... 60/403; 91/445
(58) Field of Search ..... 60/399, 403, 406; 91/445, 447

(56) References Cited

U.S. PATENT DOCUMENTS

| | | | | |
|---|---|---|---|---|
| 3,788,401 A | * | 1/1974 | Scheidt et al. | 91/445 |
| 4,204,459 A | * | 5/1980 | Johnson | 91/445 |
| 4,353,286 A | * | 10/1982 | Wetter | 91/445 |
| 4,779,836 A | | 10/1988 | Marklund | 91/33 |
| 4,955,283 A | * | 9/1990 | Hidaka et al. | 91/447 |

FOREIGN PATENT DOCUMENTS

| | | |
|---|---|---|
| EP | 952358 | 10/1999 |
| JP | 62-502982 | 11/1987 |
| JP | 2-62173 | 5/1990 |
| JP | 4-181004 | 6/1992 |
| JP | 11-303810 | 11/1999 |

* cited by examiner

*Primary Examiner*—F. Daniel Lopez
(74) *Attorney, Agent, or Firm*—Mattingly, Stanger & Malur, P.C.

(57) ABSTRACT

A hydraulic drive system includes a hose rupture control valve unit 200 having a poppet valve member 5 serving as a main valve for opening and closing communication between a cylinder connection chamber 8 and a hose connection chamber 9, a spool valve member 6 disposed in pilot passages 15*a*, 15*b* connecting a back pressure chamber 10 and the hose connection chamber 9 of the poppet valve member 5. The spool valve member is operated by a pilot pressure supplied as an external signal and operates the poppet valve member 5, and a small relief valve 7 having the function of an overload relief valve. A check valve 39 is disposed in the pilot passage 15*b* for cutting off a flow of the hydraulic fluid from the hose connection chamber 9 to the back pressure chamber 10.

A hose rupture control valve unit 200 comprises a poppet valve member 5 serving as a main valve for opening and closing communication between a cylinder connection chamber 8 and a hose connection chamber 9, a spool valve member 6 disposed in pilot passages 15*a*, 15*b* connecting a back pressure chamber 10 and the hose connection chamber 9 of the poppet valve member 5, the spool valve member being operated by a pilot pressure supplied as an external signal and operating the poppet valve member 5, and a small relief valve 7 having the function of an overload relief valve. The valve unit further comprises a check valve 39 disposed in the pilot passage 15*b* for cutting off a flow of the hydraulic fluid from the hose connection chamber 9 to the back pressure chamber 10.

3 Claims, 6 Drawing Sheets

PIPE BREAKAGE CONTROL VALVE DEVICE

TECHNICAL FIELD

The present invention relates to a hose rupture control valve unit (holding valve), which is provided in a hydraulic machine, such as a hydraulic excavator, for preventing a drop of a load upon rupture of a cylinder hose.

BACKGROUND ART

In a hydraulic machine, e.g., a hydraulic excavator, there is a need for preventing a drop of a load even if a hose or steel pipe for supplying a hydraulic fluid to a hydraulic cylinder, i.e., an actuator for driving the load such as a boom, should be ruptured. To meet such a need, a hose rupture control valve unit, also called a holding valve, is provided in the hydraulic machine. One of conventional hose rupture control valve units is disclosed in, e.g., JP,A 11-303810. FIG. 6 shows a hydraulic circuit diagram of the conventional valve unit.

Referring to FIG. 6, numeral 100 denotes a conventional hose rupture control valve unit. The valve unit 100 comprises a housing 3 provided with two input/output ports 1, 2. The input/output port 1 is directly attached to a bottom port 102*a* of a hydraulic cylinder 102, and the input/output port 2 is connected to one of actuator ports of a control valve 103 via an actuator line 105. Within the housing 3, there are provided a poppet valve member 55 serving as a main valve, a spool valve member 60 operated by a pilot pressure supplied as an external signal from a manual pilot valve 108 and operating the poppet valve member 55, and a small relief valve 7. A throttle 34 serving as pressure generating means is provided in a drain passage 15*d* of the small relief valve 7. The spool valve member 60 is of a structure having one pressure bearing chamber 17 to which the pilot pressure (external signal) is introduced, and also having another pressure bearing chamber 35 provided on the same side as the pressure bearing chamber 17 in series. The upstream side of the throttle 34 is connected to the pressure bearing chamber 35 via a signal line 36 so that the pressure generated by the throttle 34 acts upon the spool valve member 60 to provide a driving force on the same side as that provided by the pilot pressure, i.e., the external signal.

In the normal state where the actuator line 105 is not ruptured, the hose rupture control valve unit 100 operates as follows.

When supplying a hydraulic fluid to the bottom side of the hydraulic cylinder 102, a control lever of the manual pilot valve 108 is operated in a direction indicated by A for switching over the control valve 103 to its right shift position as viewed in the drawing. With the switchover of the control valve 103, the hydraulic fluid is supplied from a hydraulic pump 101 to a hose connection chamber 9 of the valve unit 100 via the control valve 103 and the pilot line 105, whereupon the pressure in the hose connection chamber 9 rises. At this time, the pressure in a cylinder connection chamber 8 of the valve unit 100 is equal to the load pressure on the bottom side of the hydraulic cylinder 102. Therefore, when the pressure in the hose connection chamber 9 becomes higher than the load pressure, the poppet valve member 55 moves upward in the drawing and the hydraulic fluid flows into the cylinder connection chamber 8, whereby the hydraulic fluid is supplied from the hydraulic pump 101 to the bottom side of the hydraulic cylinder 102.

When draining the hydraulic fluid from the bottom side of the hydraulic cylinder 102 to the control valve 103, the control lever of the manual pilot valve 108 is operated in a direction indicated by B for switching over the control valve 103 to its left shift position as viewed in the drawing. With the switchover of the control valve 103, the hydraulic fluid is supplied from the hydraulic pump 101 to the rod side of the hydraulic cylinder 102 via the control valve 103 and a pilot line 106. At the same time, the pilot pressure from the manual pilot valve 108 is introduced to the pressure bearing chamber 17 of the spool valve member 60, causing the spool valve member 60 to open by the pilot pressure. This forms a pilot flow streaming from the cylinder connection chamber 8 to the actuator line 105 via a feedback slit 11, a pilot passage 15*a*, a variable throttle portion 60*a*, and a pilot passage 15*b*. The pressure in a back pressure chamber 10 lowers under the action of the variable throttle portion 60*a* and the feedback slit 11, whereby the poppet valve member 55 is opened at an opening degree in proportion to the opening degree of the variable throttle portion 60*a*. Accordingly, the hydraulic fluid on the bottom side of the hydraulic cylinder 102 is drained to the control valve 103 while the flow rate is controlled, and then drained to a reservoir 109.

In the condition where the load pressure on the bottom side of the hydraulic cylinder 102 becomes high, such as encountered when holding a suspended load with the control valve 103 maintained in a neutral position, the poppet valve member 55 in its cutoff position holds the load pressure and fulfills the function of reducing the amount of leakage (i.e., the function of a holding valve) similarly to a conventional holding valve.

When an excessive external force acts upon the hydraulic cylinder 102 and the pressure in the cylinder connection chamber 8 is increased, the pressure on the input side of the small relief valve 7 rises, whereupon the small relief valve 7 is opened and the hydraulic fluid flows into the drain passage 15*d*, in which the throttle 34 is provided. This raises the pressure in the signal passage 36 and opens the spool valve member 60, thereby forming a pilot flow that streams from the cylinder connection chamber 8 to the actuator line 105 via the feedback slit 11, the back pressure chamber 10, and the pilot passages 15*a*, 15*b*. Accordingly, the poppet valve member 55 is opened and the hydraulic fluid at an increased pressure produced upon exertion of an external force is drained to the reservoir 109 through an overload relief valve 107*a*, which is connected to the actuator line 105. As a result, equipment breakage can be prevented.

In the event of rupture of the actuator line 105, the following problem occurs in point of safety if the hose rupture control valve unit 100 is not provided. When the hydraulic cylinder 102 is, e.g., a boom cylinder for moving a boom of a hydraulic excavator up and down, the hydraulic fluid on the bottom side of the hydraulic cylinder 102 flows out from the ruptured actuator line 105, thus causing a drop of the boom. The hose rupture control valve unit 100 serves to ensure safety in such an event. More specifically, as with the case of holding a suspended load as mentioned above, the poppet valve member 55 in the cutoff position functions as a holding valve to prevent outflow of the hydraulic fluid from the bottom side of the hydraulic cylinder 102, whereby a drop of the boom is prevented. Also, when lowering the boom down to a safety position from the condition where the boom is held in midair, the control lever of the manual pilot valve 108 is operated in the direction indicated by B, whereupon the pilot pressure from the manual pilot valve 108 is introduced to the pressure bearing chamber 17 of the spool valve member 60. The spool valve member 60 is opened by the pilot pressure, and hence the poppet valve member 55 is also opened. As a result, the hydraulic fluid on the bottom side of the hydraulic cylinder 102 can be drained while the flow rate of the drained hydraulic fluid is controlled, allowing the boom to be slowly lowered.

DISCLOSURE OF THE INVENTION

However, the above-described prior art has the problem as follows.

In the conventional hose rupture control valve unit shown in FIG. 6, when the hydraulic cylinder 102 is, e.g., the boom cylinder for moving the boom of the hydraulic excavator up and down as mentioned above, the control lever of the manual pilot valve 108 is sometimes abruptly reversed from the shift position in the direction B to the opposite shift position in the direction A, as viewed in the drawing, for quickly changing the operating direction of the boom from the downward to the upward. With such an abrupt reversed operation of the control valve, the boom-raising pilot pressure generated upon the control lever being operated in the direction A rises for switching over the control valve 103 to the right shift position in the drawing before the boom-lowering pilot pressure generated upon the control lever being operated in the direction B lowers down to a level lower than the valve-opening pressure of the spool valve member 60. This causes a main flow rate to be introduced to the hose connection chamber 9 of the hose rupture control valve unit 100 through the actuator line 105 before the spool valve member 60 is closed. Therefore, the boom-raising thrust pressure induced by the main flow rate is introduced to the hose connection chamber 9 of the hose rupture control valve unit 100, and at the same time a part of the main flow rate is introduced to the back pressure chamber 10 of the poppet valve member 55 via the pilot passages 15*b*, 15*a*. Opening of the poppet valve member 55 is thereby impeded and delayed. As a result, when the operation is abruptly reversed from the mode of raising the boom to the mode of lowering it, the startup of the boom-raising operation is delayed and the smooth operation cannot be obtained. A similar problem also occurs when the member driven by the hydraulic cylinder 102 is other than the boom.

An object of the present invention is to provide a hose rupture control valve unit which comprises a main valve constituted by a poppet valve member and a pilot valve constituted by a spool valve member and controlling the operation of the main valve, and in which a hydraulic fluid can be supplied from a hose connection chamber to a cylinder connection chamber even in the condition of a pilot pressure acting upon the spool valve member, so that the smooth operation can be obtained without a delay in opening of the poppet valve member upon an abrupt reversed lever operation.

(1) To achieve the above object, the present invention provides a hose rupture control valve unit comprising a poppet valve member slidably disposed within a housing between a supply/drain port of a hydraulic cylinder and a hydraulic hose, the housing being provided with a cylinder connection chamber connected to the supply/drain port, a hose connection chamber connected to the hydraulic hose, and a back pressure chamber, the poppet valve member serving as a main valve for selectively cutting off and establishing communication between the cylinder connection chamber and the hose connection chamber; and a spool valve member disposed in pilot passages connecting the back pressure chamber and the hose connection chamber, and operated by the external signal to selectively cut off and establish communication through the pilot passages, the poppet valve member having throttle passages for communicating the cylinder connection chamber and the back pressure chamber with each other, wherein the hose rupture control valve unit further comprises pressure control means for preventing a pressure from being generated in the back pressure chamber to such an extent as impeding opening of the poppet valve member when a hydraulic fluid is introduced from the hydraulic hose to the hose connection chamber before the spool valve member is closed.

By providing the pressure control means for preventing a pressure from being generated in the back pressure chamber to such an extent as impeding opening of the poppet valve member when a hydraulic fluid is introduced from the hydraulic hose to the hose connection chamber before the spool valve member is closed, the hydraulic fluid can be supplied from the hose connection chamber to the cylinder connection chamber even in the condition of a pilot pressure acting upon the spool valve member. As a result, the smooth operation can be obtained without a delay in opening of the poppet valve member upon an abrupt reversed lever operation.

(2) In above (1), preferably, the pressure control means is a check valve disposed in the pilot passage and cutting off a flow of the hydraulic fluid from the hose connection chamber to the back pressure chamber.

With that feature, even when the hydraulic fluid is introduced from the hydraulic hose to the hose connection chamber before the spool valve member is closed, the pressure of the hydraulic fluid in the hose connection chamber is not transmitted to the back pressure chamber. It is therefore possible to prevent a pressure from being generated in the back pressure chamber to such an extent as impeding opening of the poppet valve member.

(3) Also, in above (1), preferably, the pressure control means comprises a check valve provided inside the poppet valve member and allowing a flow of the hydraulic fluid from the back pressure chamber to the cylinder connection chamber, and means disposed in the pilot passage and generating a differential pressure between the hose connection chamber and the back pressure chamber.

With that feature, even if the hydraulic fluid is supplied from the hose connection chamber to the back pressure chamber when the hydraulic fluid is introduced from the hydraulic hose to the hose connection chamber before the spool valve member is closed, the hydraulic fluid is allowed to pass through the check valve and a pressure is prevented from accumulating in the back pressure chamber. Also, since a differential pressure occurs between the hose connection chamber and the back pressure chamber so that the pressure in the back pressure chamber lowers, it is therefore possible to prevent a pressure from being generated in the back pressure chamber to such an extent as impeding opening of the poppet valve member.

BEST MODE FOR CARRYING OUT THE INVENTION

Embodiments of the present invention will be described below with reference to the drawings.

Figure 1:
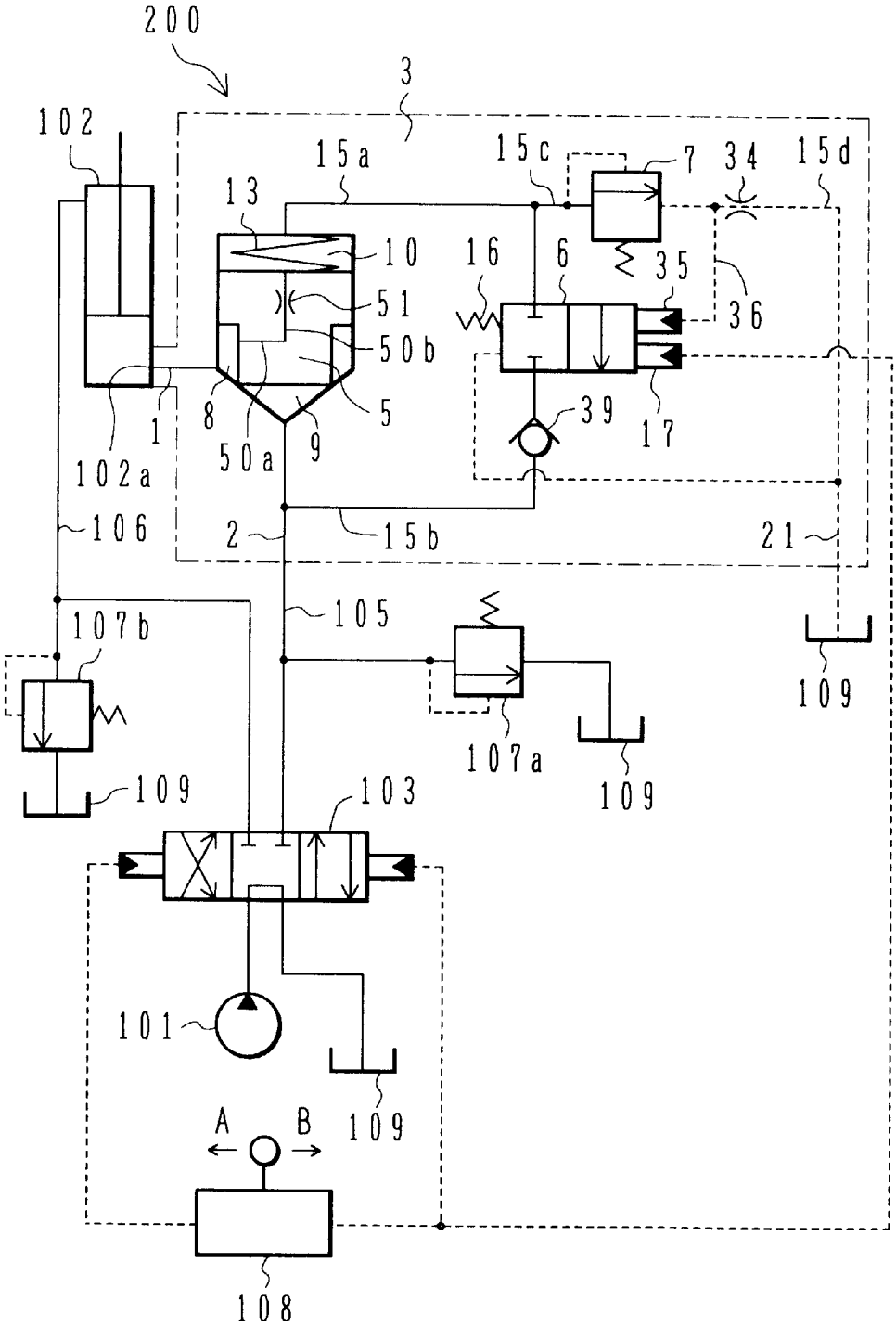
FIG. 1 is a hydraulic circuit diagram showing a hose rupture control valve unit according to a first embodiment of the present invention, along with a hydraulic drive system in which the hose rupture control valve unit is disposed.
Figure 2:
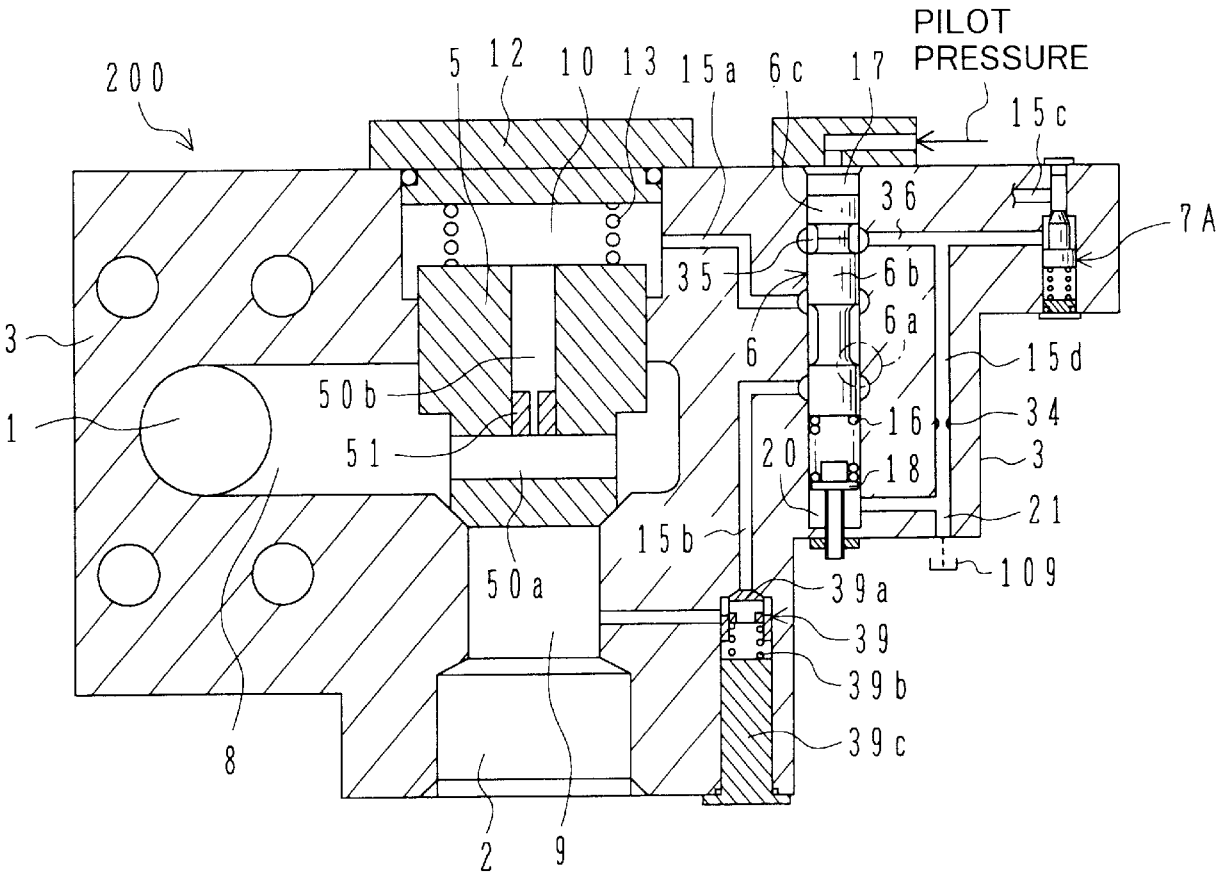
FIG. 2 is a sectional view showing a structure of the hose rupture control valve unit shown in FIG. 1.

FIG. 1 is a hydraulic circuit diagram showing a hose rupture control valve unit according to a first embodiment of the present invention, and FIG. 2 is a sectional view showing a structure of the hose rupture control valve unit shown in FIG. 1.

Referring to FIG. 1, numeral 200 denotes a hose rupture control valve unit of this embodiment. A hydraulic drive system, in which the valve unit 200 is disposed, comprises a hydraulic pump 101; a hydraulic actuator (hydraulic cylinder) 102 driven by a hydraulic fluid delivered from the hydraulic pump 101; a control valve 103 for controlling a flow of the hydraulic fluid supplied from the hydraulic pump 101 to the hydraulic cylinder 102; main overload relief valves 107*a*, 107*b* connected respectively to actuator lines 105, 106, which are extended from the control valve 103, and controlling a maximum load pressure in the circuit; a manual pilot valve 108; and a reservoir 109. The hydraulic cylinder 102 is, e.g., a boom cylinder for driving a boom of a hydraulic excavator up and down.

The hose rupture control valve unit 200 comprises, as shown in FIGS. 1 and 2, a housing 3 provided with two input/output ports 1, 2. The input/output port 1 is directly attached to a bottom port 102*a* of a hydraulic cylinder 102, and the input/output port 2 is connected to one of actuator ports of a control valve 103 via the actuator line 105.

Within the housing 3, there are provided a poppet valve member 5 serving as a main valve, a spool valve member 6 operated by a pilot pressure supplied as an external signal from the manual pilot valve 108 and operating the poppet valve member 5, and a small relief valve 7 having the function of an overload relief valve.

Also, within the housing 3, there are formed a cylinder connection chamber 8 connected to the input/output port 1, the hose connection chamber 9 connected to the input/output port 2, and a back pressure chamber 10. The poppet valve member 5 serving as the main valve is slidably disposed within the housing 3 such that it bears at a back surface the pressure in the back pressure chamber 10, selectively cuts off and establishes communication between the cylinder connection chamber 8 and the hose connection chamber 9, and varies an opening area depending on the amount of movement thereof. The poppet valve member 5 has passages 50*a*, 50*b* formed therein for communication between the cylinder connection chamber 8 and the back pressure chamber 10, and a fixed throttle portion 51 is provided in the passage 50*b*. The back pressure chamber 10 is closed by a plug 12 (see FIG. 2), and a spring 13 for holding the poppet valve member 5 in the cutoff position, as shown, is disposed in the back pressure chamber 10.

Further, within the housing 3, there are formed the pilot passages 15*a*, 15*b* for connecting the back pressure chamber 10 and the hose connection chamber 9. The spool valve member 6 serving as the pilot valve is disposed so as to selectively establish and cut off communication between the pilot passages 15*a*, 15*b*.

The spool valve member 6 has an opening/closing portion 6*a* capable of selectively establishing and cutting off communication between the pilot passages 15*a*, 15*b*. A weak spring 16 for holding the spool valve member 6 in a valve-closed position (position at which the opening/closing portion 6*a* is closed) at one operating end of the spool valve member 6 in the valve-closing-direction, and a pressure bearing chamber 17, to which the pilot pressure serving as the external signal is introduced, is provided at the other operating end of the spool valve member 6 in the valve-opening direction. When the pilot pressure (external signal) is introduced to the pressure bearing chamber 17, the spool valve member 6 is moved downward as viewed in FIG. 2, whereupon the opening/closing portion 6*a* is opened for opening of the spool valve member 6. The spring 16 is supported by a spring receiver 18, and a spring chamber 20, in which the spring 16 is disposed, is connected to the reservoir via a drain passage 21 for smooth movement of the spool valve member 6.

Moreover, within the housing 3, there are formed a relief passage 15*c* positioned on the input side of the small relief valve 7, and a drain passage 15*d* positioned on the output side of the small relief valve 7. The relief valve 15*c* is connected to the back pressure chamber 10 via the pilot passage 15*a*, and the drain passage 15*d* is connected to the reservoir 109 via the drain passage 21. Further, a throttle 34 serving as pressure generating means is disposed in the drain passage 15*d*, and a signal passage 36 is branched from a position between the small relief valve 7 and the throttle 34.

In addition to the pressure bearing chamber 17 to which the pilot pressure (external signal), another pressure bearing chamber 35 is provided at the operating end of the spool valve member 6 in the valve-opening direction. The signal passage 36 is connected to the pressure bearing chamber 35 so that the pressure generated by the throttle 34 is introduced to the pressure bearing chamber 35. The spool valve member 6 is divided into two portions 6*b*, 6*c* within an area to define the pressure bearing chamber 35. When the pilot pressure is introduced to the pressure bearing chamber 17, the two portions 6*b*, 6*c* are moved downward in the drawing to bring the opening/closing portion 6*a* into its open state while they are kept in a one-piece condition contacting with each other. When the pressure generated by the throttle 34 is introduced to the pressure bearing chamber 35, the two portions 6*b*, 6*c* are separated from each other and only the downward portion 6*b* is moved downward in the drawing to bring the opening/closing portion 6*a* into its open state. In other words, both of the pilot pressure introduced to the pressure bearing chamber 17 and the pressure generated by the throttle 34 and introduced to the pressure bearing chamber 35 act as driving forces to open the spool valve member 6.

The valve unit 200 of this embodiment further comprises a check valve 39, which is disposed in the pilot passage 15*b* formed within the housing 3 and cuts off a flow of the hydraulic fluid streaming from the hose connection chamber 9 to the back pressure chamber 10. The check valve 39 comprises a check valve member 39*a* and a spring 39*b* for holding the check valve member 39*a* in a valve-closed position. The spring 39*b* is held by a plug 39*c*.

The operation of the hose rupture control valve unit 200 having the above-described construction will be described below.

The description is first made of the normal state in which the actuator line 105 is not ruptured.

1) When Hydraulic Fluid is Supplied to Bottom Side of Hydraulic Cylinder 102

When a control lever of the manual pilot valve 108 is operated in a direction indicated by A for switching over the control valve 103 to its right shift position as viewed in the drawing, the hydraulic fluid is supplied from the hydraulic pump 101 to the hose connection chamber 9 of the valve unit 200 via the control valve 103 and the pilot line 105, whereupon the pressure in the hose connection chamber 9 rises. At this time, since the pressure in the cylinder connection chamber 8 of the valve unit 200 is equal to the load pressure on the bottom side of the hydraulic cylinder 102 and the back pressure chamber 10 is communicated with the cylinder connection chamber 8 via a throttle passage, which is made up of the passages 50*a*, 50*b* and the fixed throttle portion 51, the pressure in the back pressure chamber 10 is also equal to the load pressure on the bottom side of the hydraulic cylinder 102. Therefore, while the pressure in the hose connection chamber 9 is lower than the load pressure, the poppet valve member 5 is held in the cutoff position. However, when the pressure in the hose connection chamber 9 becomes higher than the load pressure, the poppet valve member 5 moves upward in the drawing, enabling the hydraulic fluid to flow into the cylinder connection chamber 8, whereby the hydraulic fluid is supplied from the hydraulic pump 101 to the bottom side of the hydraulic cylinder 102. Additionally, while the poppet valve member 5 is moved upward, the hydraulic fluid in the back pressure chamber 10 is allowed to move to the cylinder connection chamber 8 via the throttle passage, which is made up of the passages 50*a*, 50*b* and the fixed throttle portion 51, for smooth valve opening of the poppet valve member 5. Accordingly, the hydraulic fluid from the rod side of the hydraulic cylinder 102 is drained to the reservoir 109 via the control valve 103.

2) When Hydraulic Fluid is Drained to Control Valve 103 from Bottom Side of Hydraulic Cylinder 102

When the control lever of the manual pilot valve 108 is operated in a direction indicated by B for switching over the control valve 103 to its left shift position as viewed in the drawing, the hydraulic fluid is supplied from the hydraulic pump 101 to the rod side of the hydraulic cylinder 102 via the control valve 103 and the pilot line 106. At the same time, the pilot pressure from the manual pilot valve 108 is introduced to the pressure bearing chamber 17 of the spool valve member 6, causing the spool valve member 6 to open by the pilot pressure. This forms a pilot flow streaming from the cylinder connection chamber 8 to the actuator line 105 via the throttle passage, which is made up of the passages 50*a*, 50*b* and the fixed throttle portion 51, the back pressure chamber 10, and the pilot passages 15*a*, 15*b*. The pressure in the back pressure chamber 10 lowers under the throttling action of the fixed throttle portion 51, whereby the poppet-valve member 5 is opened. Accordingly, the hydraulic fluid on the bottom side of the hydraulic cylinder 102 is drained to the control valve 103 and then drained to the reservoir 109.

3) When Holding Load Pressure on Bottom Side of Hydraulic Cylinder 102

In the condition where the load pressure on the bottom side of the hydraulic cylinder 102 becomes high, such as encountered when holding a suspended load with the control valve 103 maintained in a neutral position, the poppet valve member 5 in its cutoff position holds the load pressure and fulfills the function of reducing the amount of leakage (i.e., the function of a holding valve) similarly to a conventional holding valve.

4) When Excessive External Force Acts upon Hydraulic Cylinder 102

When an excessive external force acts upon the hydraulic cylinder 102 and the pressure in the cylinder connection chamber 8 is increased, the pressure in the relief passage 15*c* rises via the throttle passage, which is made up of the passages 50*a*, 50*b* and the fixed throttle portion 51, the back pressure chamber 10, and the pilot passage 15*a*, whereupon the small relief valve 7 is opened and the hydraulic fluid flows into the drain passage 15*d*, in which the throttle 34 is disposed. This raises the pressure in the signal passage 36 and opens the spool valve member 6, thereby forming a pilot flow that streams from the cylinder connection chamber 8 to the actuator line 105 via the throttle passage, which is made up of the passages 50*a*, 50*b* and the fixed throttle portion 51, the back pressure chamber 10, and the pilot passages 15*a*, 15*b*. Accordingly, the poppet valve member 5 is opened and the hydraulic fluid having an increased pressure and produced upon exertion of an external force is drained to the reservoir 109 through the overload relief valve 107*a*, which is connected to the actuator line 105. As a result, equipment breakage can be prevented. Since the flow rate of the hydraulic fluid passing through the small relief valve 7 at that time is small, the function equivalent to that of a conventional overload relief valve can be realized by the small relief valve 7 having a smaller size.

In the event of rupture of the actuator line 105, as with the case of holding a suspended load as mentioned above, the poppet valve member 5 in the cutoff position functions as a holding valve to prevent outflow of the hydraulic fluid from the bottom side of the hydraulic cylinder 102, whereby a drop of the boom is prevented. Also, when lowering the boom down to a safety position from the condition where the boom is held in midair, the control lever of the manual pilot valve 108 is operated in the direction indicated by B, whereupon the pilot pressure from the manual pilot valve 108 is introduced to the pressure bearing chamber 17 of the spool valve member 6. The spool valve member 6 is opened by the pilot pressure, and hence the poppet valve member 5 is also opened. As a result, the hydraulic fluid on the bottom side of the hydraulic cylinder 102 can be drained, allowing the boom to be slowly lowered.

Figure 3:
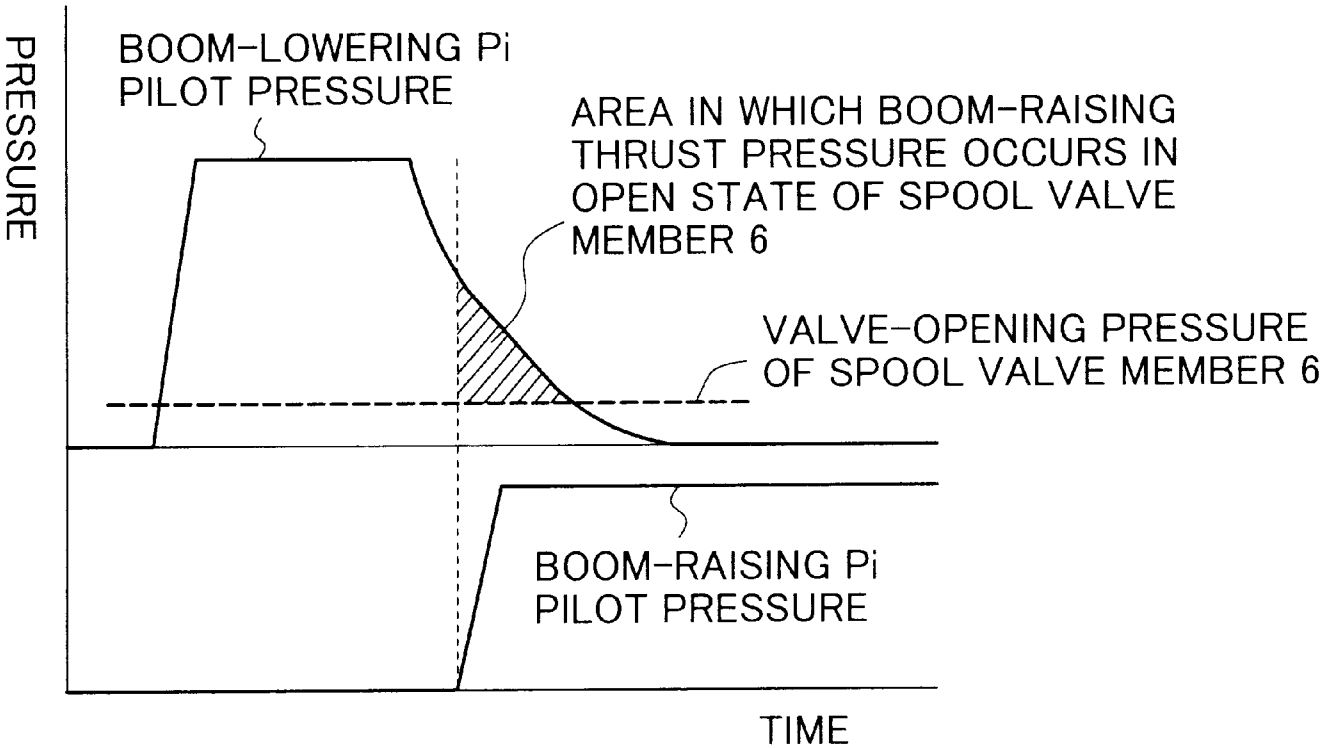
FIG. 3 is a graph showing change in pilot pressure generated by a manual pilot valve when a control lever operation is abruptly reversed.

Also, in the normal operation in which the actuator line 105 is not ruptured, the control lever of the manual pilot valve 108 is sometimes abruptly reversed from the shift position in the direction B to the opposite shift position in the direction A, as viewed in the drawing, for quickly changing the operating direction of the boom from the downward to the upward. With such an abrupt reversed operation of the control valve, the pilot pressure generated by the manual pilot valve 108 varies as shown in FIG. 3. More specifically, as shown by a hatched area in FIG. 3, the boom-raising pilot pressure generated upon the control lever being operated in the direction A rises for switching over the control valve 103 to the right shift position in the drawing before the boom-lowering pilot pressure generated upon the control lever being operated in the direction B lowers down to a level lower than the valve-opening pressure of the spool valve member 6. This causes a main flow rate to be introduced to the hose connection chamber 9 of the hose rupture control valve unit through the actuator line 105 before the spool valve member 6 is closed. In the conventional hose rupture control valve unit not including the check valve 39, therefore, the boom-raising thrust pressure induced by the main flow rate is introduced to the hose connection chamber 9, and at the same time a part of the main flow rate is introduced to the back pressure chamber 10 of the poppet valve member 5, as described above. As a result, opening of the poppet valve member 5 is impeded and delayed.

In contrast, in this embodiment, even when the boom-raising thrust pressure induced by the main flow rate is introduced to the hose connection chamber 9 before the spool valve member 6 is opened, the thrust pressure is not introduced to the back pressure chamber 10 by the provision of the check valve 39. Therefore, the poppet valve member 5 is reliably opened, and the smooth operation can be obtained without a delay in the startup of the boom-raising operation.

With this embodiment, as described above, just by providing the poppet valve member 5 in a flow passage through which all flow rate of the hydraulic fluid supplied to and discharged from the hydraulic cylinder 102 passes, the poppet valve member 5 can fulfill the functions of the check valve for fluid supply, the load check valve, and the overload relief valve in the hose rupture control valve unit. Accordingly, a valve unit having a small pressure loss can be constructed, and highly efficient operation can be achieved with a less energy loss.

Also, since the poppet valve member 5 is reliably opened upon the abrupt operation for reversing the boom from the downward to upward direction, the smooth operation can be obtained without a delay in the startup of the boom-raising operation.

Figure 4:
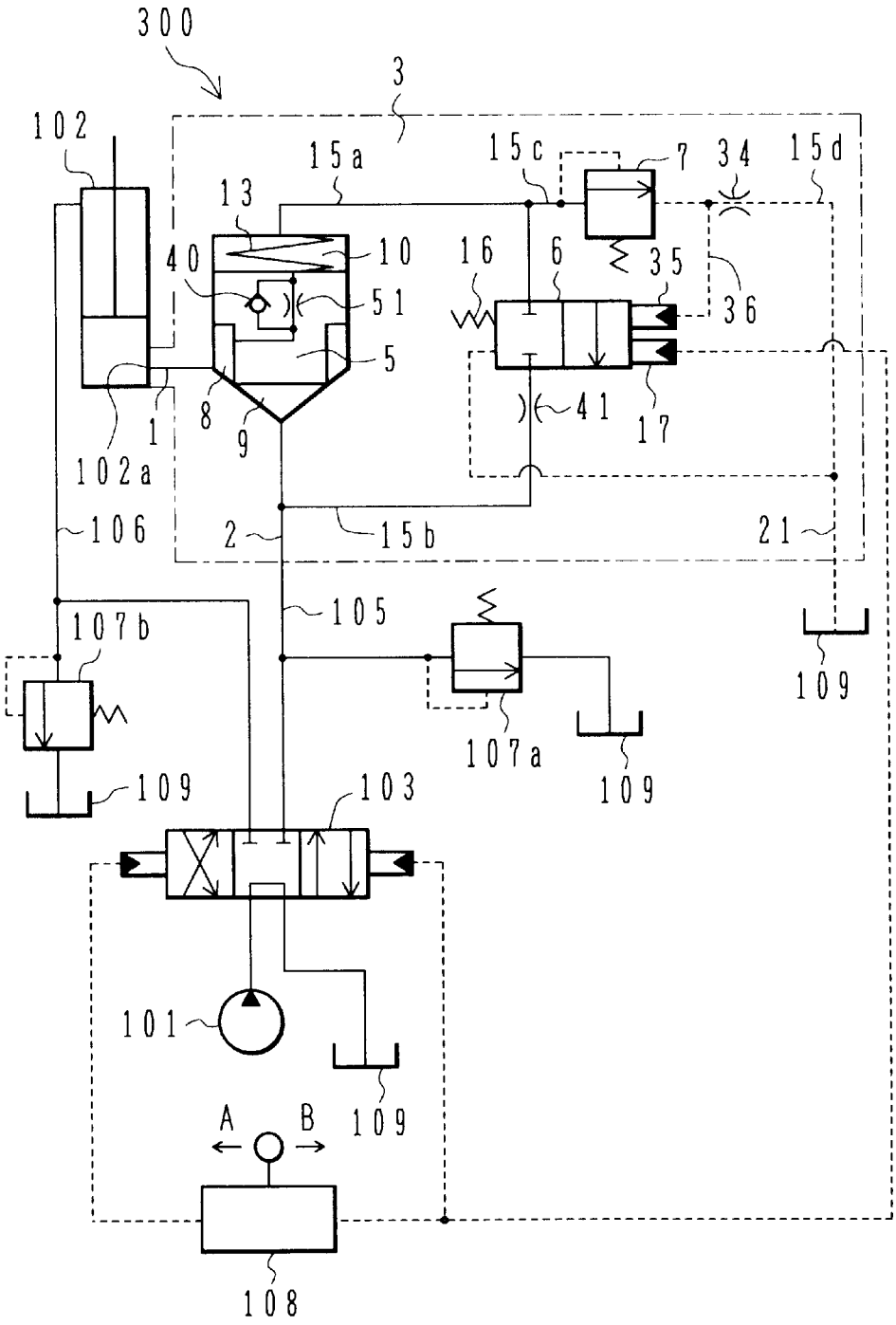
FIG. 4 is a hydraulic circuit diagram showing a hose rupture control valve unit according to a second embodiment of the present invention, along with a hydraulic drive system in which the hose rupture control valve unit is disposed.
Figure 5:
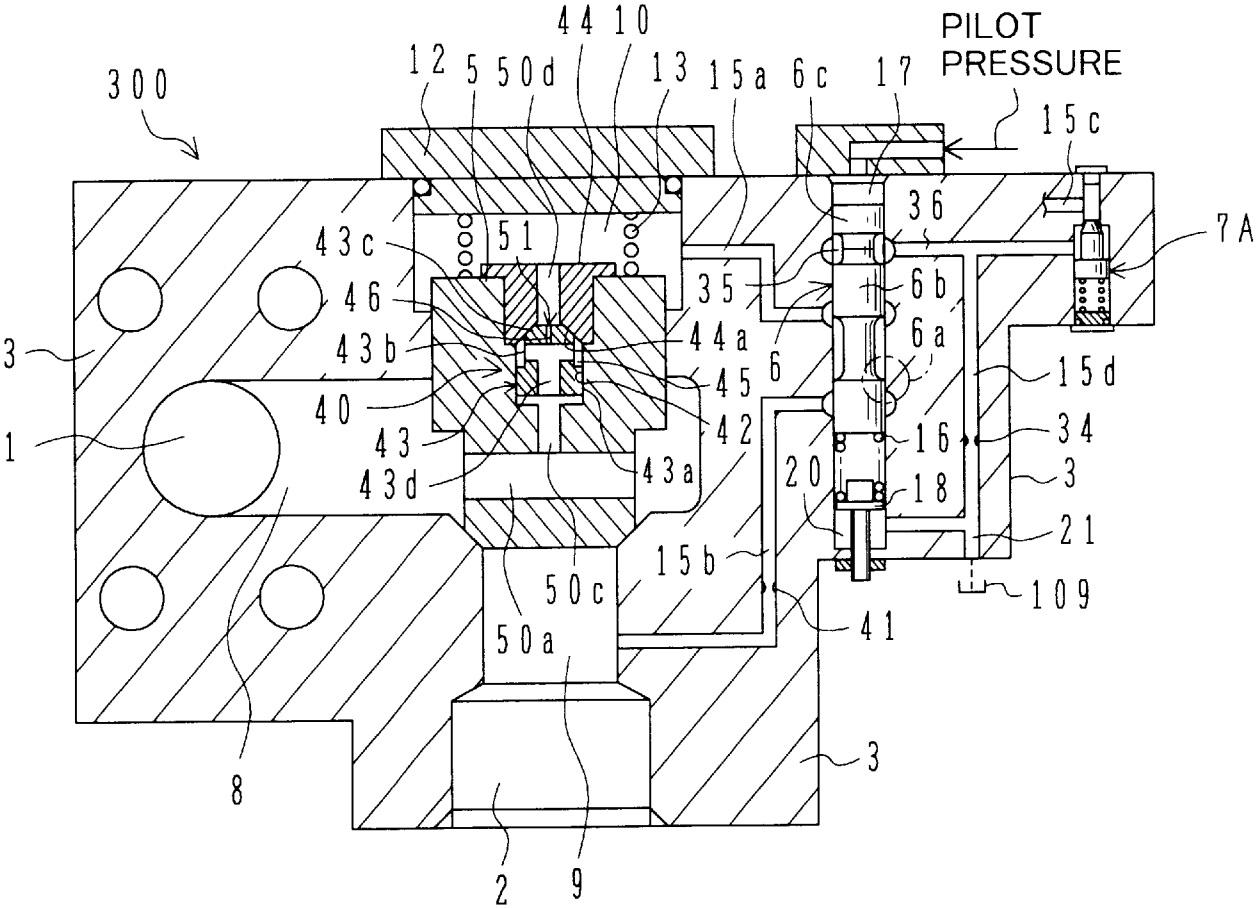
FIG. 5 is a sectional view showing a structure of the hose rupture control valve unit shown in FIG. 4.
Figure 6:
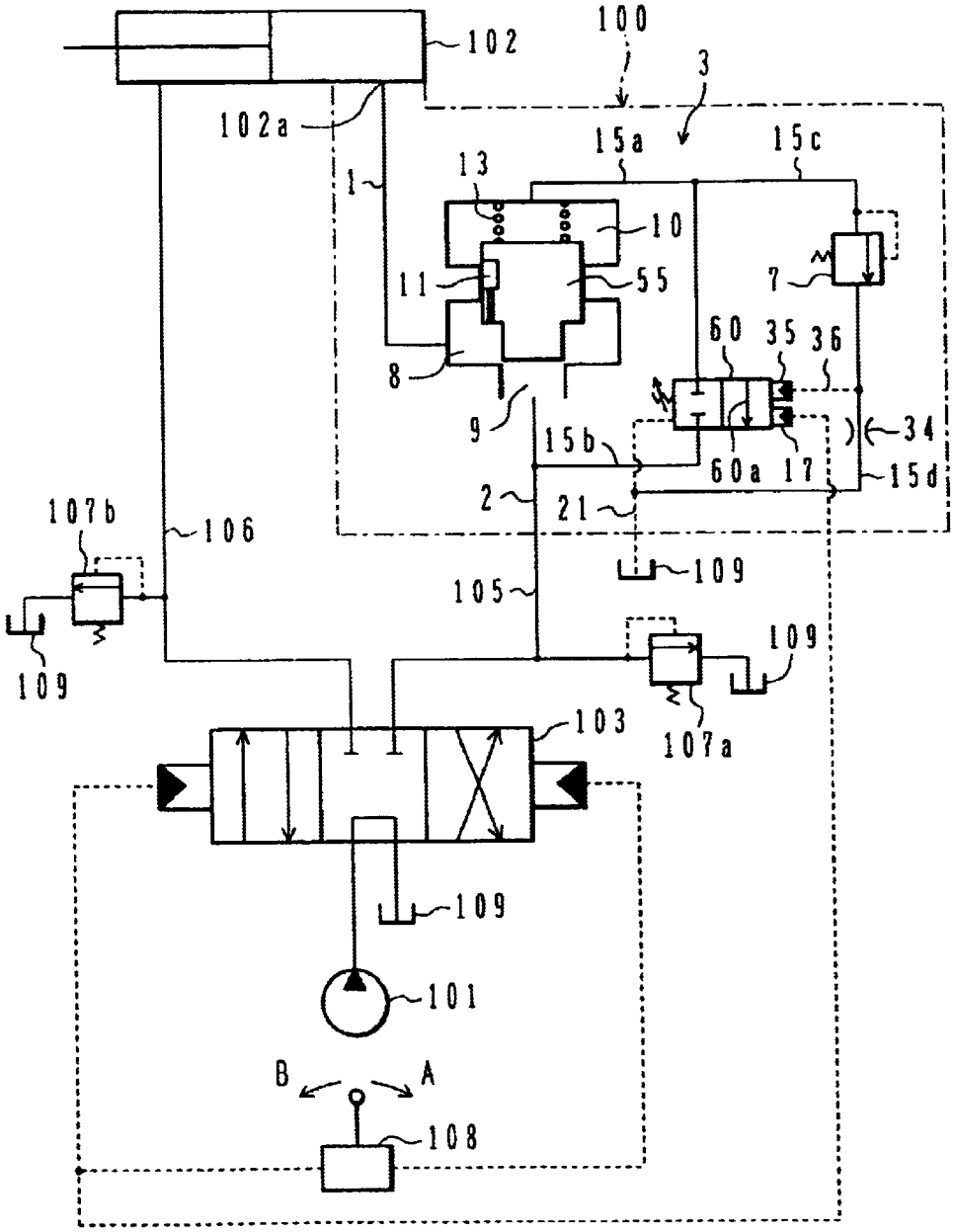
FIG.6 PRIOR ART
FIG. 6 is a hydraulic circuit diagram showing a conventional hose rupture control valve unit along with a hydraulic drive system in which the hose rupture control valve unit is disposed.

A second embodiment of the present invention will be described with reference to FIGS. 4 and 5. In FIGS. 4 and 5, identical components to those in FIGS. 1 and 2 are denoted the same characters.

Referring to FIGS. 4 and 5, a hose rupture control valve unit 300 of this embodiment includes, instead of the check valve 39 provided in the first embodiment, a check valve 40 disposed within the poppet valve member 5 and allowing the hydraulic fluid to flow only from the back pressure chamber 10 to the hose connection chamber 9, and a fixed throttle portion 41 provided in the pilot passage 15*b*.

The check valve 40 is constructed integrally with the fixed throttle portion 51.

More specifically, as shown in FIG. 5, the passage 50*a* is formed inside the poppet valve member 5 as a passage for communicating the cylinder connection chamber 8 and the back pressure chamber 10, similarly to the first embodiment. In addition, a passage 50*c* is formed as a part of the passage 50*b* provided in the first embodiment, and a valve chamber 42 is formed on the side of the passage 50*c* nearer to the back pressure chamber 10.

The check valve 40 has a valve member 43 disposed in the valve chamber 42. The valve chamber 42 is closed by a plug 44, and the valve member 43 is movable in the valve chamber 42 up and down as viewed in the drawing. The valve member 43 comprises two cylindrical base portions 43*a*, 43*b* having different diameters, and a conical valve portion 43*c*. The cylindrical base portion 43*b* has a smaller diameter than the cylindrical base portion 43*a*, and a passage 45 is formed around the cylindrical base portion 43*b*. An internal passage 43*d* is formed inside the cylindrical base portions 43*a*, 43*b* for communicating the passage 45 with the passage 50*c*.

A passage 50*d* is formed in the plug 44 as a part of the passage 50*b* provided in the first embodiment, and a conical valve seat 44*a*, against which a conical head of the valve portion 43*c* is seated, is formed at an end of the plug 44 on the side facing the valve chamber 42. Further, a small-diameter passage 46 is formed in the valve portion 43*c* for communicating the internal passage 43*d* with the passage 50*d* in the plug 44. The small-diameter passage 46 functions as the fixed throttle portion 51.

When the pressure in the cylinder connection chamber 8 is higher than that in the back pressure chamber 10, the valve member 43 is moved to the position as shown, whereby the check valve 40 is closed and the cylinder connection chamber 8 is communicated with the back pressure chamber 10 through the small-diameter passage 46, i.e., the fixed throttle portion 51. Accordingly, the flow of the hydraulic fluid from the cylinder connection chamber 8 to the back pressure chamber 10 is provided only the flow passing through the fixed throttle portion 51.

When the pressure in the back pressure chamber 10 is higher than that in the cylinder connection chamber 8, the valve member 43 is moved downward from the position shown in the drawing, whereby the valve portion 43*c* of the valve member 43 is separated away from the valve seat portion 44*a* to open the check valve 40. Therefore, the flow of the hydraulic fluid from the back pressure chamber 10 to the cylinder connection chamber 8 is provided as the flow passing through the passage 50*d*, the check valve 40 (i.e., a passage between the valve portion 43*c* and the valve seat portion 44*a*, the passage 45 and the internal passage 43*d*), and the passage 50*c*.

This embodiment having the above-described construction operates similarly to the first embodiment in normal conditions, such as 1) when the hydraulic fluid is supplied to the bottom side of the hydraulic cylinder 102, 2) when the hydraulic fluid is drained from the bottom side of the hydraulic cylinder 102 to the control valve 103, 3) when holding the load pressure on the bottom side of the hydraulic cylinder 102, and 4) when an excessive external force acts upon the hydraulic cylinder 102, as well as in the event of rupture of the pilot line 105.

Further, when the control valve is abruptly reversed, this embodiment also operates in a like manner as the first embodiment. More specifically, even when the boom-raising thrust pressure induced by the main flow rate is introduced to both of the hose connection chamber 9 and the back pressure chamber 10 in the condition of the spoo1 valve member 6 being in the open position upon abrupt change (abrupt reversed lever operation) from the operation of moving the hydraulic cylinder 102 upward to the operation of moving it downward (i.e., from boom-raising to boom-lowering), the thrust pressure introduced to the back pressure chamber 10 is released to the cylinder connection chamber 8 through the check valve 40, and the pressure in the back pressure chamber 10 becomes lower than that in the hose connection chamber 9 by the provision of the throttle portion 41. Therefore, the poppet valve member 5 is opened, and the smooth operation can be obtained without a delay in the startup of the boom-raising operation.

Accordingly, this embodiment can also provide similar advantages as those obtainable with the first embodiment.

In the embodiments described above, the spool valve member 6 and the poppet valve member 5 are each constituted as an opening/closing valve by providing respectively the opening/closing portion 6*a* and the fixed throttle portion 51 in the spool valve member 6 and the poppet valve member 5. However, as disclosed in JP,A 11-303810, the spool valve member and the poppet valve member may be each constituted as a variable throttle valve, which controls a flow rate passing through itself depending on the pilot pressure (external signal) supplied from the manual pilot valve, by providing a variable throttle portion in the spool valve member and by providing, in the poppet valve member 5, a feedback slit that increases its opening area depending on the amount of movement of the poppet valve member and controls the amount of a pilot flow, which flows out from the cylinder connection chamber to the back pressure chamber, depending on the opening area. In such a case, by providing the check valve 39 or both the check valve 40 and the throttle portion 41, similar advantages to those described above can also be obtained even when the hydraulic fluid is introduced from the hydraulic hose 105 to the hose connection chamber 9 before the spool valve member 6 is closed.

While in the above-described embodiments, the check valve 39 or the throttle portion 41, which constitutes pressure control means, is disposed in the pilot passage 15*b*, it is a matter of course that the check valve 39 or the throttle portion 41 may be disposed on the side of the pilot passage 15*a*.

Industrial Applicability

According to the present invention, a hydraulic fluid can be supplied from a hose connection chamber to a cylinder connection chamber even in the condition of a pilot pressure acting upon a spool valve member, so that the smooth operation can be obtained without a delay in opening of the poppet valve member upon an abrupt reversed lever operation.

What is claimed is:

1. A hydraulic drive system comprising a hydraulic pump (101), a hydraulic cylinder (102) driven by a hydraulic fluid delivered from the hydraulic pump, a control valve (103) for controlling a flow of hydraulic fluid supplied from said hydraulic pump to said hydraulic cylinder, a hose rupture control valve unit (200) for controlling a discharge side of said hydraulic cylinder when one (102*a*) of two supply/drain ports of said hydraulic cylinder functions as said discharge side, and first and second hydraulic hoses (105, 106) connected to extend from a control valve, said control valve having first and second shift positions such that when said control valve is shifted to the first position, the hydraulic fluid from the hydraulic pump is supplied to said hydraulic cylinder through said control valve, first hydraulic hose (105) and hose rupture control valve unit (200) and the hydraulic fluid discharged from said hydraulic cylinder is recircualated to a tank (109) through said second hydraulic hose (106) and control valve and when said control valve is shifted to the second position, the hydraulic fluid from the hydraulic pump is supplied to said hydraulic cylinder through said control valve and second hydraulic hose (106) and the hydraulic fluid discharged from the hydraulic cylinder recirculated to the tank through said hose rupture control valve unit, first hydraulic hose (105) and control valve wherein:

said hose rupture control valve unit (200) comprises:

a housing (3) provided with a cylinder connection chamber (8) connected to said one (102*a*) of said supply/drain ports of said hydraulic cylinder, a hose connection chamber (9) connected to said first hydraulic hose (105), and a back pressure chamber (10);

a poppet valve member (5) slidably disposed within said housing housing and serving as a valve for selectively cutting cutting off and establishing communication between said cylinder connection chamber and said hose connection chamber;

a pilot passage (15*a*, 15*b*) connecting said back pressure chamber and said hose connection chamber;

a spool valve member (6) disposed in said pilot passage and operable to open when an external signal based on a command signal for shifting said control valve (103) into said second position is applied, thereby establishing communication through said pilot passage;

throttle passages (50*a*, 50*b*, 51) provided in said poppet valve member for communicating said cylinder connection chamber and said back pressure chamber with each other; and pressure control means (39; 40, 41) for preventing a pressure from being generated in said back pressure chamber (10) to such an extent as impeding opening of said poppet valve member (5) when said control valve is shifted from said second position to said first position and a hydraulic fluid is introduced from said hydraulic hose (105) to said hose connection chamber (9) before said spool valve member (6) is is closed upon release of the external signal.

2. A hydraulic drive system according to claim 1, wherein said pressure control means is a check valve (39) disposed in said pilot passage (15*b*) and cutting off a flow of the hydraulic fluid from said hose connection chamber (9) to said back pressure chamber (10).

3. A hydraulic drive system according to claim 1, wherein said pressure control means comprises a check valve (40) provided inside said poppet valve member (5) and allowing a flow of the hydraulic fluid from said backpressure chamber (10) to said cylinder connection chamber (8), and means (41) disposed said pilot passage (15*b*) and generating a differential pressure between said hose connection chamber (9) and said back pressure chamber (10).

* * * * *